US005500281A

United States Patent [19]

Srinivasan et al.

[11] Patent Number: 5,500,281

[45] Date of Patent: Mar. 19, 1996

[54] ABSORBENT, FLUSHABLE, BIO-DEGRADABLE, MEDICALLY-SAFE NONWOVEN FABRIC WITH PVA BINDING FIBERS, AND PROCESS FOR MAKING THE SAME

[75] Inventors: Ramesh Srinivasan, Billerica; James Bottomley, Andover; W. Andrew Coslett, Medfield, all of Mass.

[73] Assignee: International Paper Company, Purchase, N.Y.

[21] Appl. No.: 200,597

[22] Filed: Feb. 23, 1994

[51] Int. Cl.[6] ..... D04H 1/58

[52] U.S. Cl. ..... 428/288; 428/131; 428/296; 428/299; 428/913; 156/308.2; 156/308.6; 156/308.8; 156/309.6; 156/285; 264/123; 264/126; 28/104

[58] Field of Search ..... 428/288, 296, 428/131, 360, 913, 299; 156/308.2, 308.6, 308.8, 309.6, 28.5; 264/123, 126; 28/104

[56] References Cited

U.S. PATENT DOCUMENTS

| | | | |
|---|---|---|---|
| 3,563,241 | 2/1971 | Evans et al. | 128/284 |
| 3,915,750 | 10/1975 | Uetani et al. | 136/131 |
| 3,930,086 | 12/1975 | Harmon | 428/131 |
| 4,211,807 | 7/1980 | Yazawa et al. | 428/109 |
| 4,267,016 | 5/1981 | Okazaki et al. | 162/146 |
| 4,306,929 | 12/1981 | Menikheim et al. | 156/290 |
| 4,396,452 | 8/1983 | Menikheim et al. | 156/290 |
| 4,623,575 | 11/1986 | Brooks et al. | 428/113 |
| 4,639,390 | 1/1987 | Shoji | 428/195 |
| 4,913,943 | 4/1990 | Goossen | 428/36.1 |
| 4,942,089 | 7/1990 | Genba et al. | 428/364 |
| 4,963,230 | 10/1990 | Kawase et al. | 162/129 |

OTHER PUBLICATIONS

Brochure on "Kuralon" for Paper and Nonwoven Fabrics, by Kuraray Co., Ltd., Osaka Japan.

Brochure on "Kuraray Kuralon VP" by C. Itoh & Co., Ltd., (technical data sheets).

Material Safety Data Sheet–"Kuralon" by Kuraray Co., Ltd., Osaka Japan.

*Primary Examiner*—James J. Bell

*Attorney, Agent, or Firm*—Ostrager, Chong & Flaherty

[57] ABSTRACT

An absorbent, flushable, bio-degradable, and medically-safe nonwoven fabric suitable for use as wraps, wipes, absorbent pads, etc., is composed of from 2% to 10% by weight of untreated, water-soluble polyvinyl alcohol (PVA) fibers that are heat-bonded to a matrix of absorbent fibers. The use of PVA fibers in low amounts provides softness, while sufficient wet strength is provided by heat bonding the PVA fibers completely to the other fibers in a two-stage heating process. The resulting nonwoven fabric has a high wet-to-dry tensile strength ratio, good drape softness, and high fluid absorptive capacity. In a method for producing the nonwoven fabric, the PVA fibers are blended with the absorbent fibers, the blended fibers are carded onto a moving web, sufficient water is added to wet the PVA fibers while maintaining web integrity, then the web is heated in two stages, the first with heating cylinders at 40° C. to 80° C., then the second with heating cylinders of 60° C. to 100° C. The fiber web may also be hydroentangled and patterned for enhanced strength and textural properties.

22 Claims, 10 Drawing Sheets

| | 2 | 4 | 8 | 10 | 16 | 18 |
|---|---|---|---|---|---|---|
| gm/in/gsy | 8.29 | 18.53 | 30.44 | 41.27 | 37.11 | 39.97 |
| gsy/gmf | 1.08 | 0.5 | 0.27 | 0.21 | 0.21 | 0.18 |

| | 2 | 4 | 8 | 10 | 16 | 18 |
|---|---|---|---|---|---|---|
| gm/in/gsy | 0 | 2.41 | 3.09 | 6.32 | 6.03 | 6.03 |
| gsy/gmf | 6.67 | 3.7 | 2.13 | 1.45 | 1.37 | 1 |

ABSORBENT, FLUSHABLE, BIO-DEGRADABLE, MEDICALLY-SAFE NONWOVEN FABRIC WITH PVA BINDING FIBERS, AND PROCESS FOR MAKING THE SAME

TECHNICAL FIELD

This invention generally relates to an absorbent, flushable, bio-degradable, and medically-safe nonwoven fabric suitable for use as wraps, wipes, absorbent pads, etc., and more particularly, to such fabric formed with polyvinyl alcohol binding fibers.

BACKGROUND ART

In the industry of consumer disposables and medical nonwovens, the emphasis on development is being placed more and more on nonwoven fabrics that are bio-degradable, flushable, without chemicals, and medically safe, possess desired hand (softness) and aesthetic texture, and have sufficient wet strength for their use. Generally, it has been difficult to produce such fabric without using chemicals that may produce reactions in users, or without using mechanical bonding or thermal fusing methods that produce a denser or stiffer fabric or fabric that is not flushable or bio-degradable.

The use of polyvinyl alcohol (PVA) fibers in combination with other absorbent fibers for forming a flushable, bio-degradable nonwoven fabric is known in the industry. The PVA material is known to be medically safe for use in contact with skin or internal body tissues. However, untreated PVA fibers are water soluble and may result in a product that has unacceptably low wet strength. Therefore, prior attempts have used PVA fibers in relatively large amounts of 20% to 90%. However, use of a large amount of PVA fibers results in a product that lacks softness and has a paper-like feel.

Another approach has been to use PVA fibers that have been heat-treated or chemically treated for greater binding strength and stability. For example, in U.S. Pat. No. 4,267,016 to Okazaki, a paper or fabric is formed with PVA fibers that have been treated in a solution of PVA and an adduct of polyamide condensation product and halogen-epoxy propane or ethylene glycol digylcidyl ether in order to render them boiling-water resistant when heat treated. In U.S. Pat. No. 4,639,390 to Shoji, nonwoven fabric is formed with PVA fibers that have been heat-treated and acetalized so as to dissolve in water only at temperatures higher than 100° C. or are insoluble. Although a fabric of increased strength is provided, the use of such treated, insoluble PVA fibers results in a product that is relatively stiff, not satisfactorily flushable or bio-degradable, and/or not medically safe for some users.

SUMMARY OF INVENTION

Accordingly, it is a principal object of the present invention to provide a nonwoven fabric that possesses all of the desired properties of softness, absorbency, flushability, bio-degradability, being medically safe, and having sufficient wet strength for use as wraps, wipes, absorbent pads, etc.

In accordance with the invention, a nonwoven fabric comprises from about 2% up to about 10% of untreated, water-soluble polyvinyl alcohol (PVA) fibers that are heat-bonded to a matrix of absorbent fibers such that said fabric has a wet-to-dry tensile strength ratio of at least 25% in the machine direction (MD) and cross direction (CD), and a drape softness of between 0.5 to 4.0 gmf/gsy in the MD and 0.1 to 0.5 gmf/gsy in the CD.

An especially preferred range for the PVA fibers is from about 4% to about 8% per dry weight of fabric. The use of the low amounts of PVA fibers provides an excellent combination of softness and wet strength. The preferred absorbent fibers are cellulosic fibers such as rayon and cotton. Synthetic fibers such as acetate, polyester, nylon, polypropylene, polyethylene, etc., may also be used.

The invention also encompasses a method for producing nonwoven fabric having PVA binding fibers, comprising the steps of: blending untreated, water-soluble PVA fibers with a matrix of absorbent fibers; carding the blended fibers onto a moving web; adding water to the web in an amount sufficient to soften the PVA fibers for binding to the absorbent fibers while maintaining sufficient web integrity; heating the wetted web in a first stage of heating cylinders in a temperature range of about 40° C. to 80° C. to bind the PVA fibers to the other absorbent fibers; then further heating the web in a second stage of heating cylinders in a temperature range of about 60° C. to 100° C. to complete the binding of the fibers and drying of the web.

The wetting of the web can be accomplished by adding water through a water pickup station then removing excess water from the wetted web through vacuum suctioning. Alternatively, the water can be added in controlled amounts through a padder. The two-stage heating allows the PVA fibers to saturate their bonding points to the other fibers without unduly melting the PVA fibers and weakening them at the lower heating temperature, then completing the thermal binding and drying of the web at the higher heating temperature. The web may also be passed through an aperturing station for low-energy hydroentanglement to enhance the final fabric's strength and texture.

Other objects, features, and advantages of the present invention will become apparent from the following detailed description of the best mode of practising the invention, considered with reference to the drawings, of which:

DETAILED DESCRIPTION OF INVENTION

Figure 1:
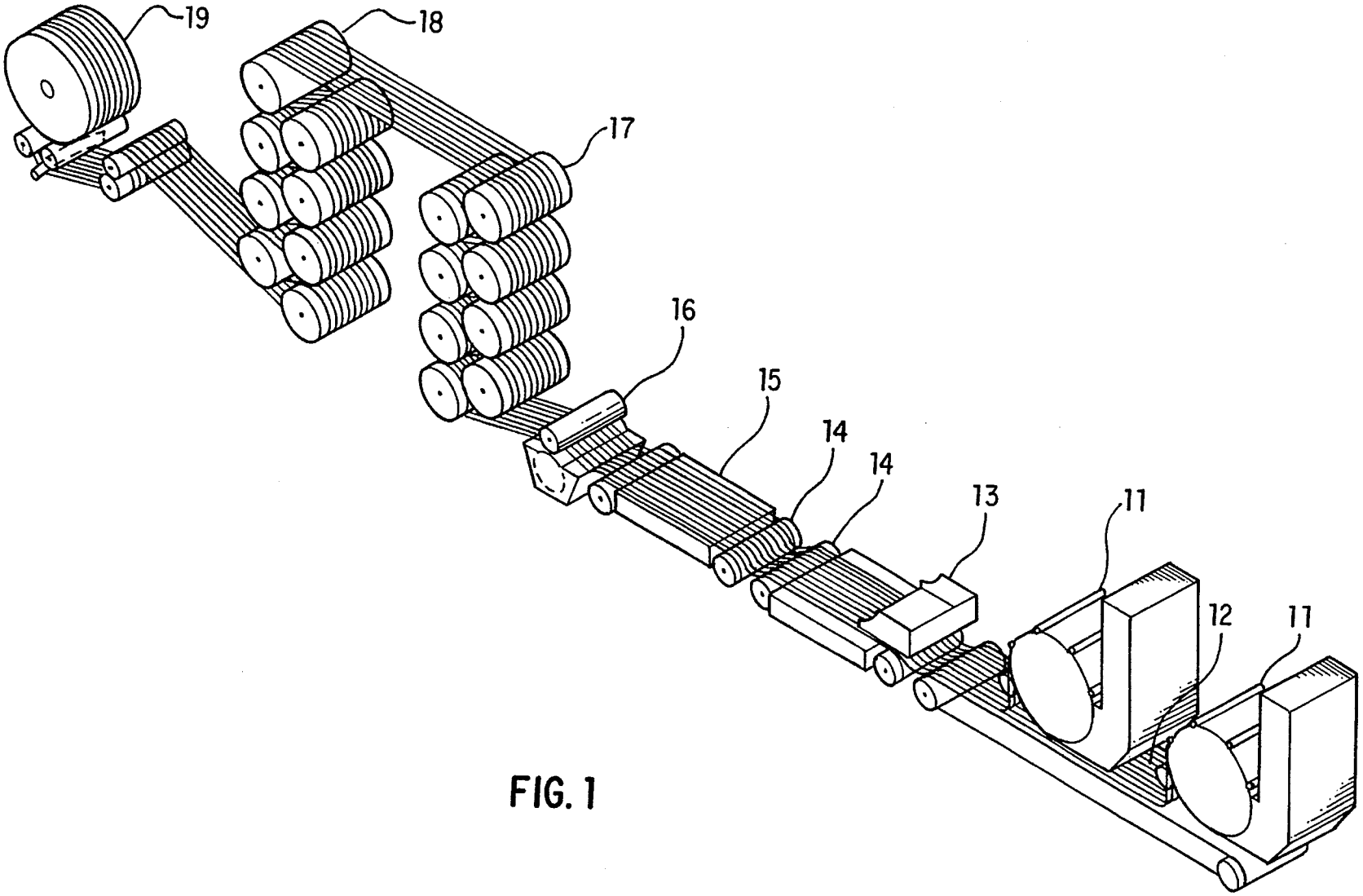
FIG. 1 illustrates a process line for producing soft, absorbent, flushable, bio-degradable, medically safe, nonwoven fabric with untreated polyvinyl alcohol (PVA) binding fibers.

Referring to FIG. 1, a process line is schematically shown for producing the nonwoven fabric in accordance with the present invention. First, PVA fibers are blended with other absorbent fibers in a completely homogenized manner using appropriate blending/opening devices (not shown) and then supplied to conventional card units 11 at a carding station 10, with or without the use of scramblers for randomizing the fiber orientation. The carded fibers are transported on a card conveyor 12. A suitable amount of water (hot or cold) is then applied to the web such that the PVA fibers become softened and the web maintains sufficient wet integrity. In the process line shown, the carded web is passed through a pre-wet station 13 which is essentially a flooder wherein water from a tank is applied onto the web. The amount of water applied is controlled using a valve. The pre-wet web with softened PVA fibers is conveyed by a web conveyor 14 through a vacuum module 15 which sucks off excess water from the web, then through a padder station 16 where water from a bath is applied to the web in a controlled amount under a nip roll.

The wet web is then passed through two stages of heating and drying stations wherein it is transported around a series of hot cylinders (steam cans). In the first station 17, the hot cylinders heat the PVA fibers to a temperature in the range of 40° C. to 80° C. in order to soften them so that they adhere to the other absorbent fibers and bind them together, thereby imparting structural integrity and strength to the web. In the second station 18, the web is heated around hot cylinders to a temperature in the range of 60° C. to 100° C. in order to dry the remaining water off and complete the heat-bonding of the fibers. The two-stage heating allows the PVA fiber bonding points to be formed completely without unduly melting the fibers and weakening them. The resulting bonded fabric is then wound up at a winding station 19. The described process is found to produce excellent results for PVA-bonded absorbent fabric such as used in tampons. The following examples demonstrated fabrics suitable for this application.

EXAMPLE 1

Rayon/RVA Blended Fabrics

Using the fabrication process illustrated in FIG. 1, the fiber blend was composed of 95% rayon of 1.5 denier/filament by 40 mm length, obtained from Courtaulds Company in Alabama, USA, sold under the designation Rayon 18453, and 5% PVA fibers of 3.0 denier/filament by 51 mm length, obtained from Kuraray Company in Okayama, Japan, under the designation PVA VPB 201×51. Two card units were used, but the cold water pre-wet flooder was not used. Five sample runs were obtained using straight or scrambled web orientation and at line speeds varying from 45 to 125 feet/minute. The padder used a doctor blade pressure of 40 psi, nip pressure of 40 psi, roll type of 30 cc/yd$^2$, and cold water mix. The steam pressure was 20 psi around the first-stage heating cylinders and 40 psi around the second-stage heating cylinders. The fabric had a basis weight of 15 gm/yd$^2$, width of 33–34 inches, and thickness of 8 to 11 mils. The fabric properties measured for four sample runs are shown in Table IA.

The tests showed that best results were obtained in Run #4 using a fiber blend of 92% rayon and 8% PVA. This run used scrambling of the fiber orientation on the web and a line speed of 50 feet per minute (fpm). Tensile strength in the machine direction (MD) and the cross direction (CD) was measured by strip test (1"×7" sample) in grams/inch (gm/in). Run #4 had the highest ratio of wet-to-dry tensile strength (33%) and the highest combined measure of wet strength for MD and CD. Run #3 had relatively poor wet strength. The drape softness was measured by the INDA Standard Test Method for Handle-O-Meter Stiffness of Nonwoven Fabrics (IST 90.3–92) in units of gram-force (gmf) per 8.0×8.0 in.$^2$ test samples (units in Table 1A are converted to gmf/gsy by multiplying by 0.05).

TABLE 1A

| RUN # | LINE SPD. fpm | RAYN/ PVA % | DRY TENS MD STRIP gm/in | WET TENS MD STRIP gm/in | DRY TENS CD STRIP gm/in | WET TENS CD STRP g/in | HOM Soft MD STRP gmf | HOM Soft CD STRP gmf |
|---|---|---|---|---|---|---|---|---|
| 1 Straight web | 45 | 95/5 | 1371.1 | 431.3 | 59.0 | 18.2 | 21.0 | 2.5 |
| 2 Scrambld web | 75 | 95/5 | 1121.4 | 340.5 | 167.9 | 45.4 | 24.0 | 5.0 |
| 3 Straight web | 100 | 95/5 | 1738.8 | 213.4 | 49.9 | 13.6 | 21.0 | 1.9 |
| 4 Scrambld web | 50 | 92/8 | 1184.9 | 417.7 | 222.5 | 63.6 | 27.0 | 5.4 |

TABLE 1B

PVA IN BLEND (%) VERSUS NONWOVEN PROPERTIES

| RUN # | Wt. gsy | Rayon/ PVA % | Dry tens MD strip g/in/gsy | Wet tens MD strip g/in/gsy | Dry tens CD strip g/in/gsy | Wet tens CD strip g/in/gsy | H-O-M Soft MD strip gmf/gsy | H-O-M Soft CD strip gmf/gsy |
|---|---|---|---|---|---|---|---|---|
| 1 | 11.1 | 98/2 | 13.38* | 8.29* | 0.61* | 0.00* | 0.93* | 0.15* |
| 2 | 11.8 | 96/4 | 39.17* | 18.53* | 2.89* | 2.41* | 1.99* | 0.27* |
| 3 | 15.2 | 92/8 | 105.66* | 30.44* | 11.12* | 3.09* | 3.66* | 0.47* |
| 4 | 12.1 | 90/10 | 127.75 | 41.27 | 18.20 | 6.32 | 4.81 | 0.69 |
| 5 | 12.2 | 84/16 | 126.31 | 37.11 | 19.94 | 6.03 | 4.86 | 0.73 |
| 6 | 14.2 | 82/18 | 136.61 | 39.97 | 15.77 | 6.03 | 5.45 | 1.00 |

To determine the optimal fiber compositional ranges, tests were conducted using different blends of PVA binding fibers and rayon fibers. For these tests, the product to be optimized was for use as a tampon overwrap. All trials were run at 50 fpm using scrambled web. The same fabrication process as in Example 1 was used, except that no pre-wet flooder or vacuum removal of excess water was used. Instead the web was fed through a padder which controlled the amount of water added to the web.

Figure 5:
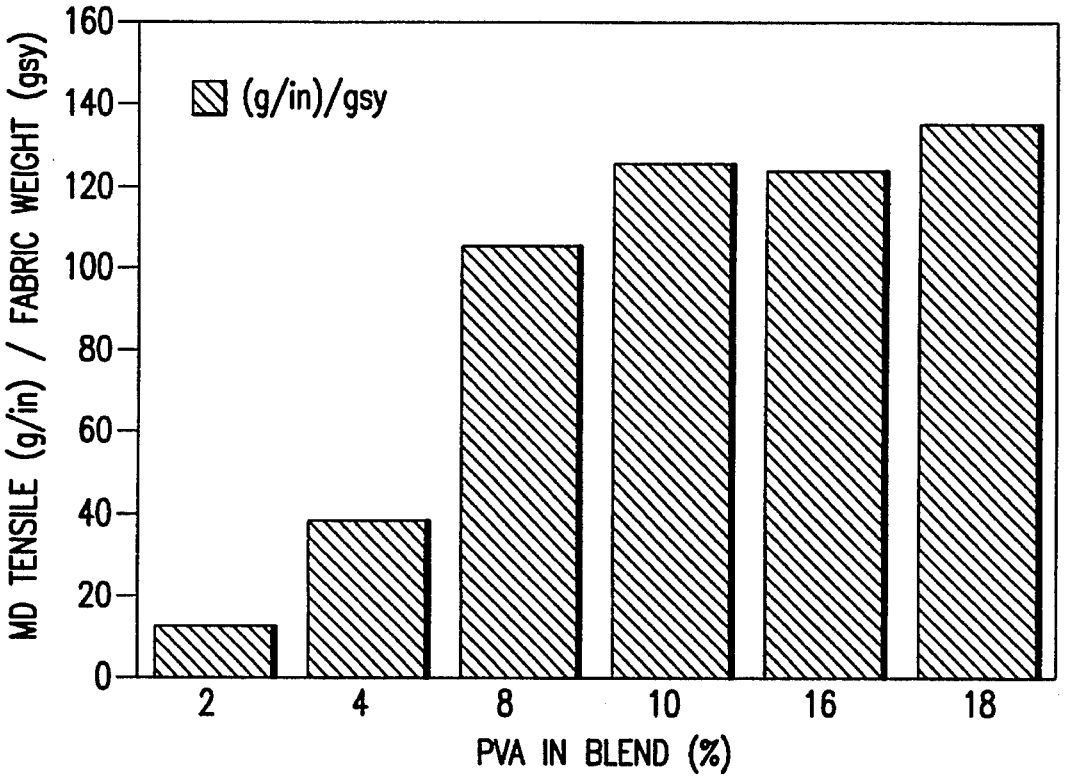
FIG. 5 is a bar chart comparing the PVA fiber percentage amount in the nonwoven fabric compared to weight-normalized machine-direction (MD) dry tensile strength.
Figure 6:
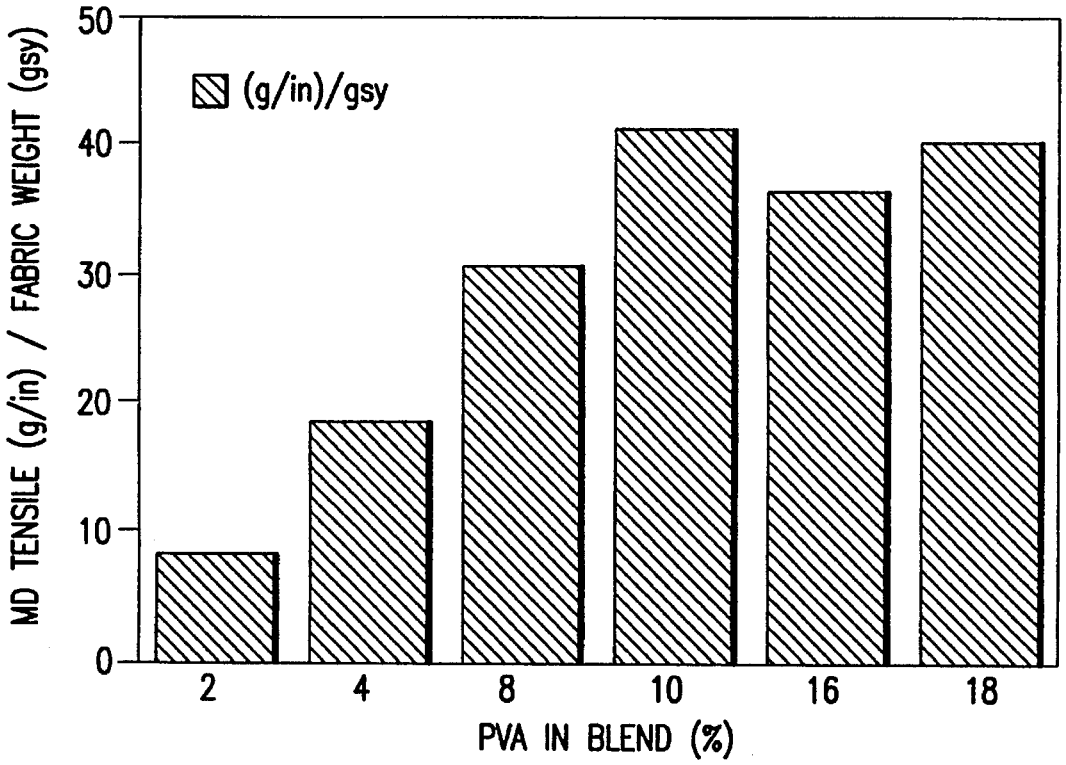
FIG. 6 is a bar chart comparing the PVA fiber percentage to MD wet tensile strength.
Figure 7:
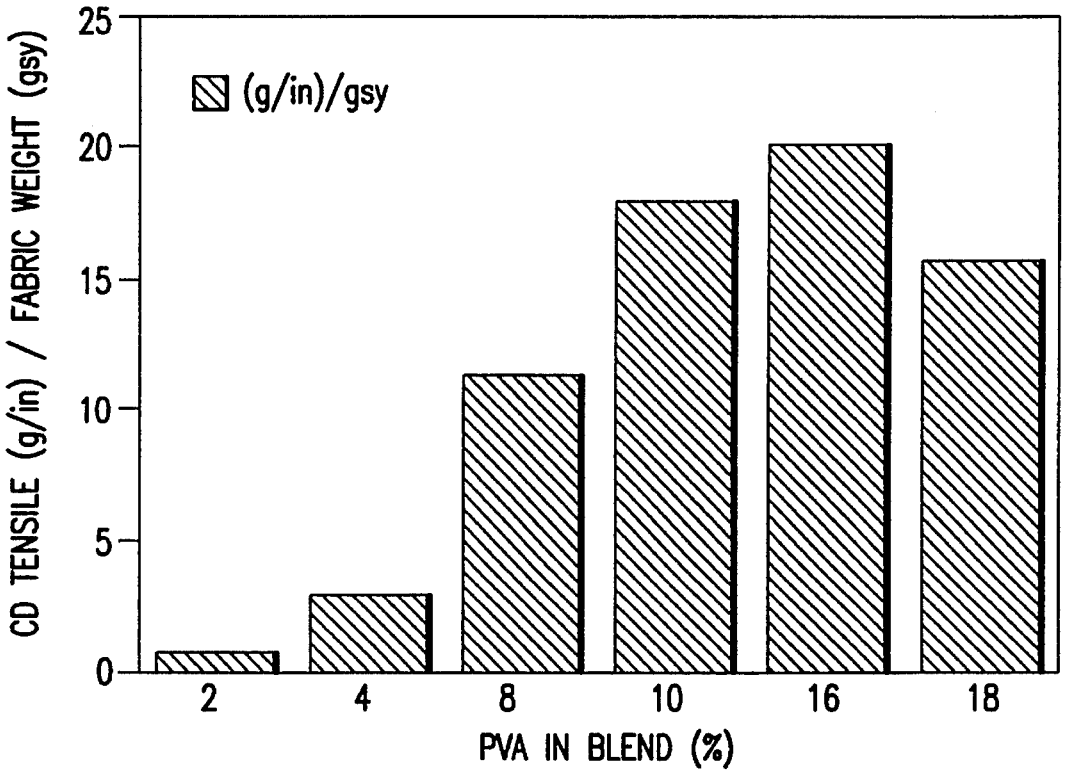
FIG. 7 is a bar chart comparing the PVA fiber percentage to cross-direction (CD) dry tensile strength.
Figure 8:
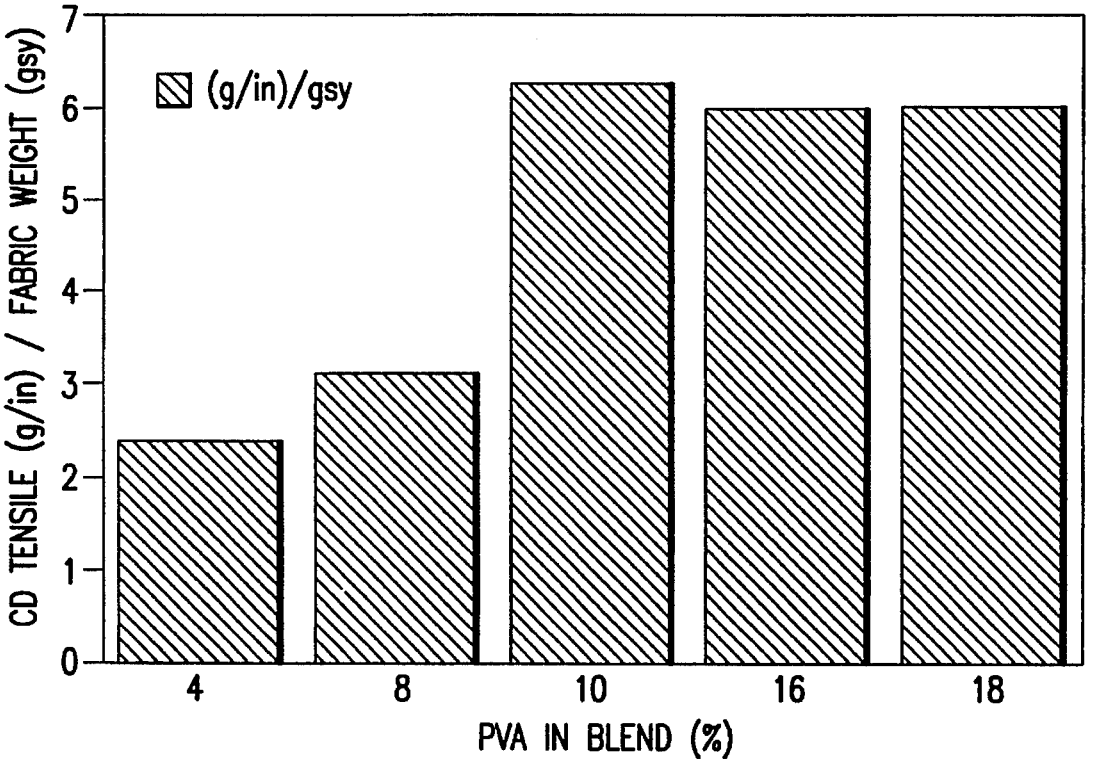
FIG. 8 is a bar chart comparing the PVA fiber percentage to CD wet tensile strength.
Figure 9:
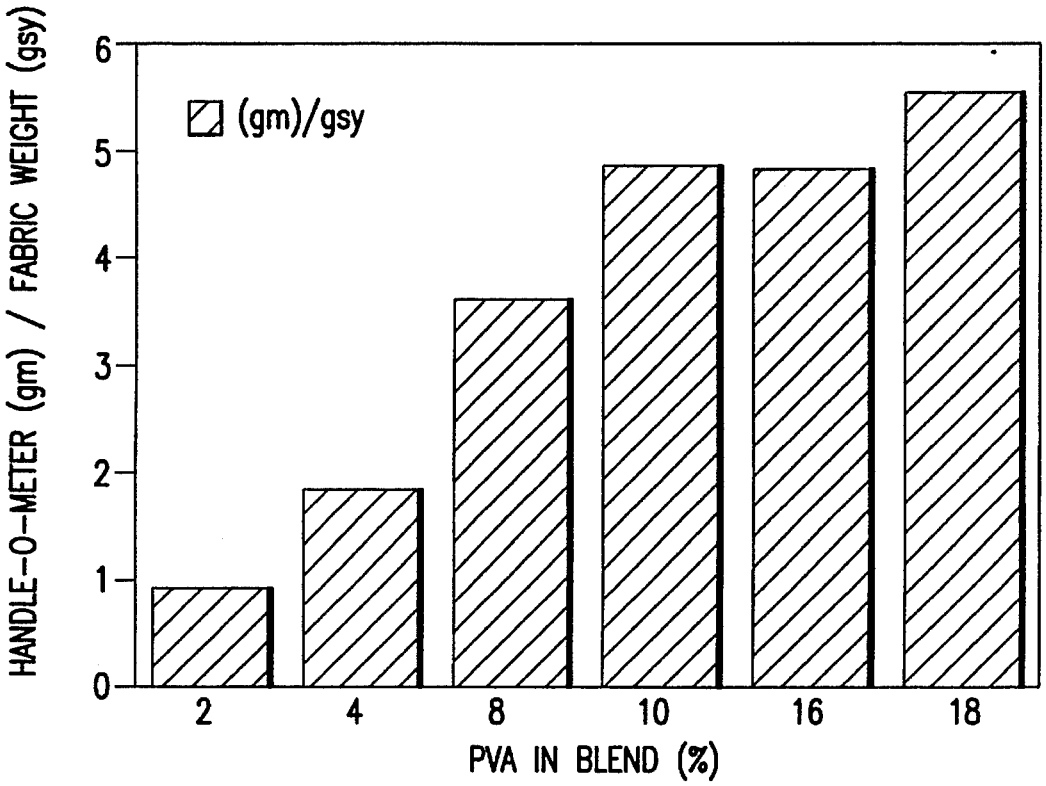
FIG. 9 is a bar chart comparing the PVA fiber percentage to MD dry softness values.
Figure 10:
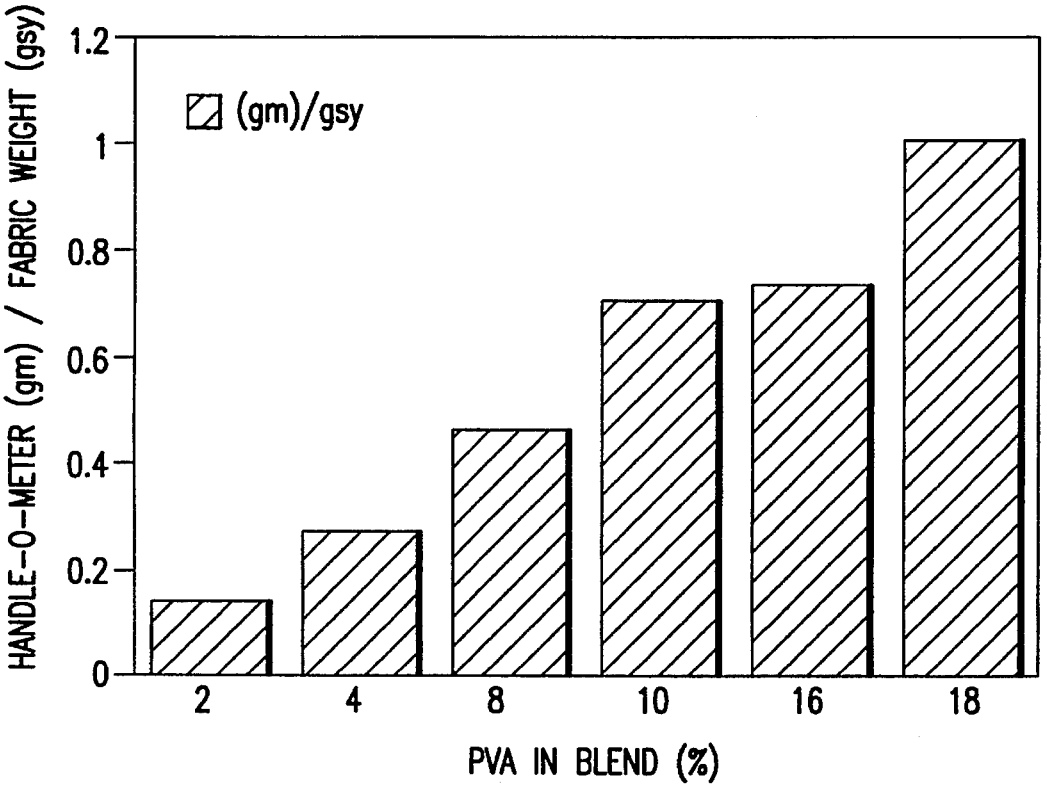
FIG. 10 is a bar chart comparing the PVA fiber percentage to CD dry softness values.

Table IB shows a summary of the PVA fiber composition of the sample fabrics and their measured physical properties. FIGS. 5–10 are bar charts depicting the tests results comparatively for different measured properties. FIG. 5 illustrates the PVA fiber percentage amount versus weight-normalized MD dry tensile strength, FIG. 6 the PVA fiber percentage versus MD wet tensile strength, FIG. 7 the PVA fiber percentage versus CD dry tensile strength, FIG. 8 the PVA fiber percentage versus CD wet tensile strength, FIG. 9 the PVA fiber percentage versus MD dry softness (handle-o-meter) values, and FIG. 10 the PVA fiber percentage versus CD dry softness values.

The above test results showed that the measured properties were excellent for PVA fiber percentages of 10% or less. The graphs in FIGS. 5–10 confirm that there is no additional value in increasing the PVA fiber percentage greater than 10% as the properties showed no statistically significant improvement. Thus, the boundary for optimal PVA fiber composition was established at 10%. In particular, the overall combination of wet and dry tensile strength and softness (values designated with asteriks) was better for PVA fiber percentages of 2%, 4%, and 8% as compared to percentages of 10% and higher. Optimum properties (adequate strength and softness) for a tampon overwrap were obtained at the 8% PVA fiber level.

Figure 11:
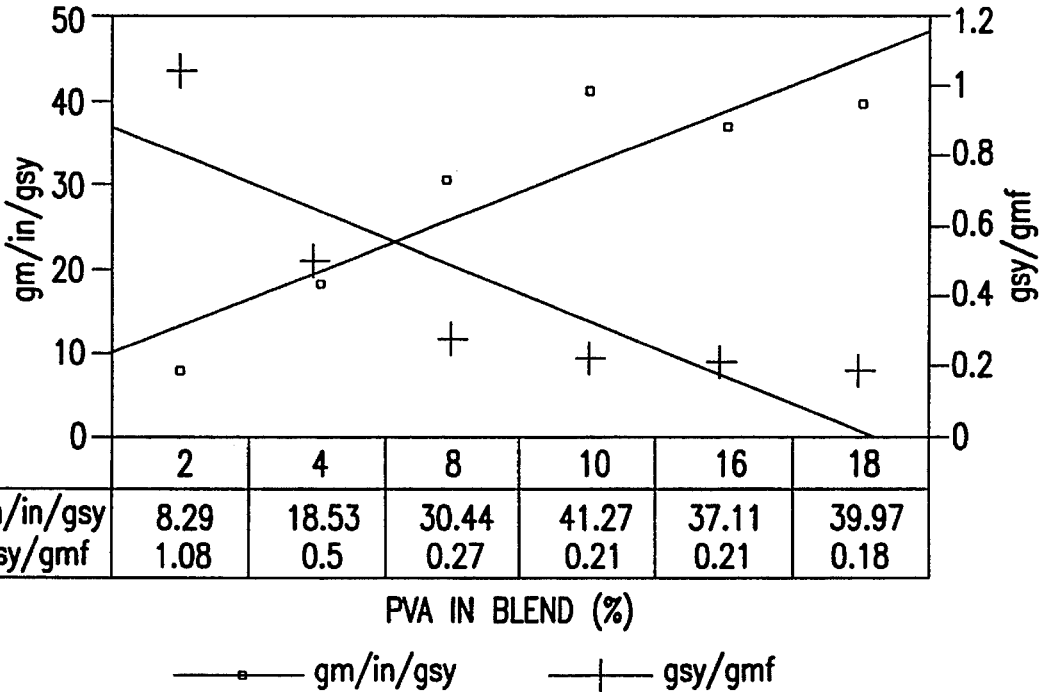
FIG. 11 illustrates the interaction of MD wet tensile strength and softness for rayon/PVA nonwoven fiber.
Figure 12:
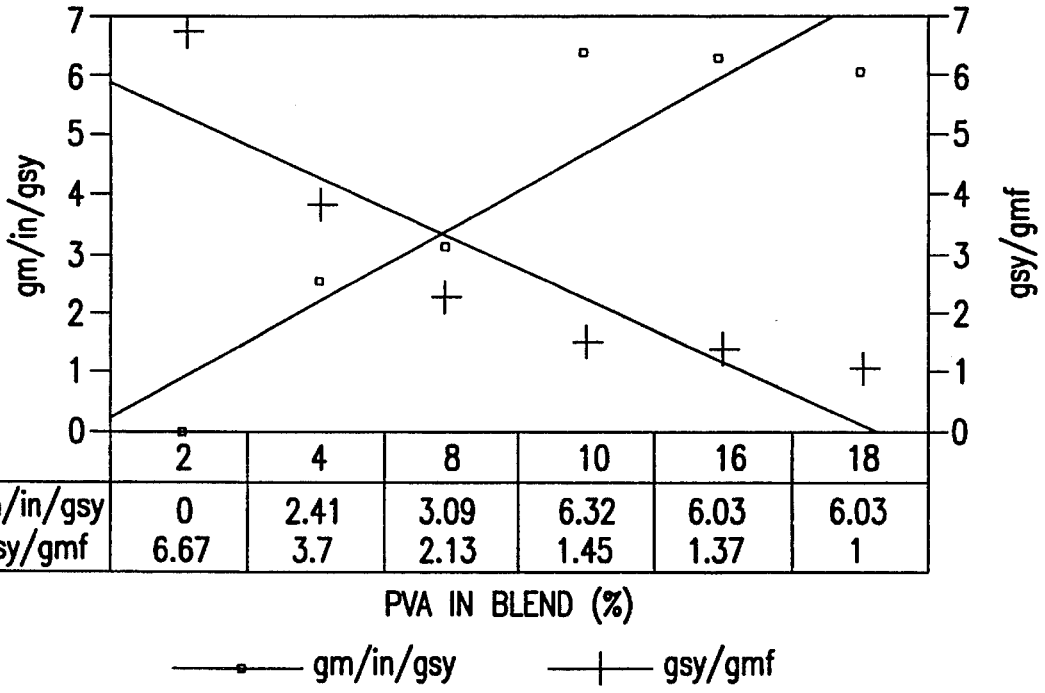
FIG. 12 illustrates the interaction of CD wet tensile strength and softness for rayon/PVA nonwoven fiber.

FIGS. 11 and 12 illustrate the interaction of the two most important variables to optimize, i.e., wet strength and dry softness. For this comparison, the values were normalized on a fabric weight basis to eliminate the effects of weight variations. The PVA fiber percentages are shown along the X-axis. Weight-normalized wet tensile strength values (gm/in/gsy) are shown along the Y1-axis. The higher the value, the stronger is the material. The inverse of weight-normalized handle-o-meter values (gsy/gmf) are shown along the Y2-axis. The higher the value, the softer is the material. These charts confirm that the optimal combination of wet strength and softness is obtained at about 8% PVA fiber composition.

EXAMPLE 2

92/8% Rayon/PVA Blend

Further tests were conducted for the optimal rayon/PVA fiber blend, using 92% rayon (1.5 dpf×40 mm, Courtaulds Rayon 18453) with 8% PVA fibers (3.0 dpf×51 mm, Kuraray PVA VPB 201 X 51). Two card units were used. Two sample runs were obtained using hot water at 60° C. for the padder with and without a lubricity agent obtained from Findley Company, of Wauwatosa, Wis., U.S.A., under the designation L9120. The padder used a doctor blade pressure of 40 psi, nip pressure of 40 psi, and roll type of 30 cc/yd$^2$. The line speed was 50 feet/minute. The steam pressure was 20 psi around the first-stage heating cylinders and 40 psi around the second-stage heating cylinders. The fabric had a basis weight of 12 to 15 gm/yd$^2$, width of 33–34 inches, and a thickness of 8–9 mils. The fabric properties are summarized in Table II.

The tests showed that the use of a lubricity agent resulted in a significant lowering of wet strength. The wet-to-dry tensile strength ratio was 33% and higher in the first run (without agent), compared to 20% and higher in the second run (with agent).

TABLE II

| RUN # | Lubricious Coatg. | DRY TENS MD STRIP gm/in | WET TENS MD STRIP gm/in | DRY TENS CD STRIP gm/in | WET TENS CD STRIP gm/in | H-O-M Soft MD STRIP gmf | H-O-M Soft CD STRIP gmf |
|---|---|---|---|---|---|---|---|
| 1 | No | 1679.8 | 562.9 | 181.6 | 59.0 | 31.0 | 7.8 |
| 2 | Yes | 1543.6 | 340.5 | 181.6 | 49.94 | 29.0 | 7.3 |

TABLE III

| RUN # | Weight gsy & Calipr mils | Prodt. Hand | DRY TENS MD GRAB gm/in | WET TENS MD GRAB gm/in | DRY TENS CD GRAB gm/in | WET TENS CD GRAB gm/in | Fluid cap. gm/gm |
|---|---|---|---|---|---|---|---|
| 1 | 88 gsy 80 mil | Flexbl | 3405.0 | 1589.0 | 998.8 | 544.8 | 18.2 |
| 2 | 94 gsy 72 mil | Flexbl | 4040.6 | 1725.2 | 3178.0 | 1407.4 | 17.6 |
| 3 | 96 gsy 63 mil | Stiff | 9216.2 | 3450.4 | 2360.8 | 1044.2 | 15.0 |

EXAMPLE 3

Hydroentangled Cotton/PVA Blend

As a process variation, tests were also conducted for hydroentangled nonwoven fabric. The nonwoven web was passed through a patterning/aperturing station for low-energy hydroentanglement on a patterned/apertured support surface to enhance the fabric's strength and texture. The fiber blend used was 92% cotton staple fibers and 8% PVA fibers (3.0 dpf×51 mm). Two card units with scramblers for randomized fiber orientation were used. Three sample runs were obtained at different basis weights between 88–96 gm/yd$^2$ with and without the doctor blade at the padder. The padder used nip pressure of 40 psi, roll type of 30 cc/yd$^2$, and cold water mix. The line speed was 50 feet/minute. The steam pressure was 20 psi around the first-stage heating cylinders and 40 psi around the second-stage heating cylinders. Fluid absorptive capacity was measured in grams of water absorbed per gram of fabric. Strength was measured with a grab test (4"×6" sample). The results are summarized in Table III.

The results showed an increase in CD wet strength using low-energy hydroentanglement (compared to Example 2 above). Wet strength was increased when the fabric was made stiffer. Fluid absorptive capacity was comparable in all runs. Other fluid handling parameters were also measured. The fabric samples showed sink times of 1.6 to 1.8 seconds, wicking in the MD of 3.0 to 3.3 cm/sec, and wicking in the CD of 3.0 to 3.3 cm/sec. The wet-to-dry strength ratio ranged between 33% to 50%.

EXAMPLE 4

Chembond Type Rayon/PVA Blend

The fiber blend used was 92% rayon (1.5 dpf×40 mm) and 8% PVA fibers (3.0 dpf×51 mm). Five sample runs were obtained at different basis weights between 37–75 gm/yd$^2$. The tests sought to maximize MD stiffness. Two or three card units (depending on weight) with scramblers, hot water of 100° C. in the flooder, variable padder nip pressure, and variable vacuum pressure were used. The line speed was 50 feet/minute. The steam pressure was 20 psi around the first-stage cylinders and 40 psi around the second-stage cylinders. Fluid absorbent capacity and drape softness/stiffness were also measured. The measured properties are summarized in Table IV.

The test showed that using limited quantities of PVA fiber in the blend and making a "chembond" type fabric allows the manufacture of a product with good strengths and absorption capacity, with enough flexibility to vary the weight, thickness, softness, etc., as desired for different grades of product.

Figure 2:
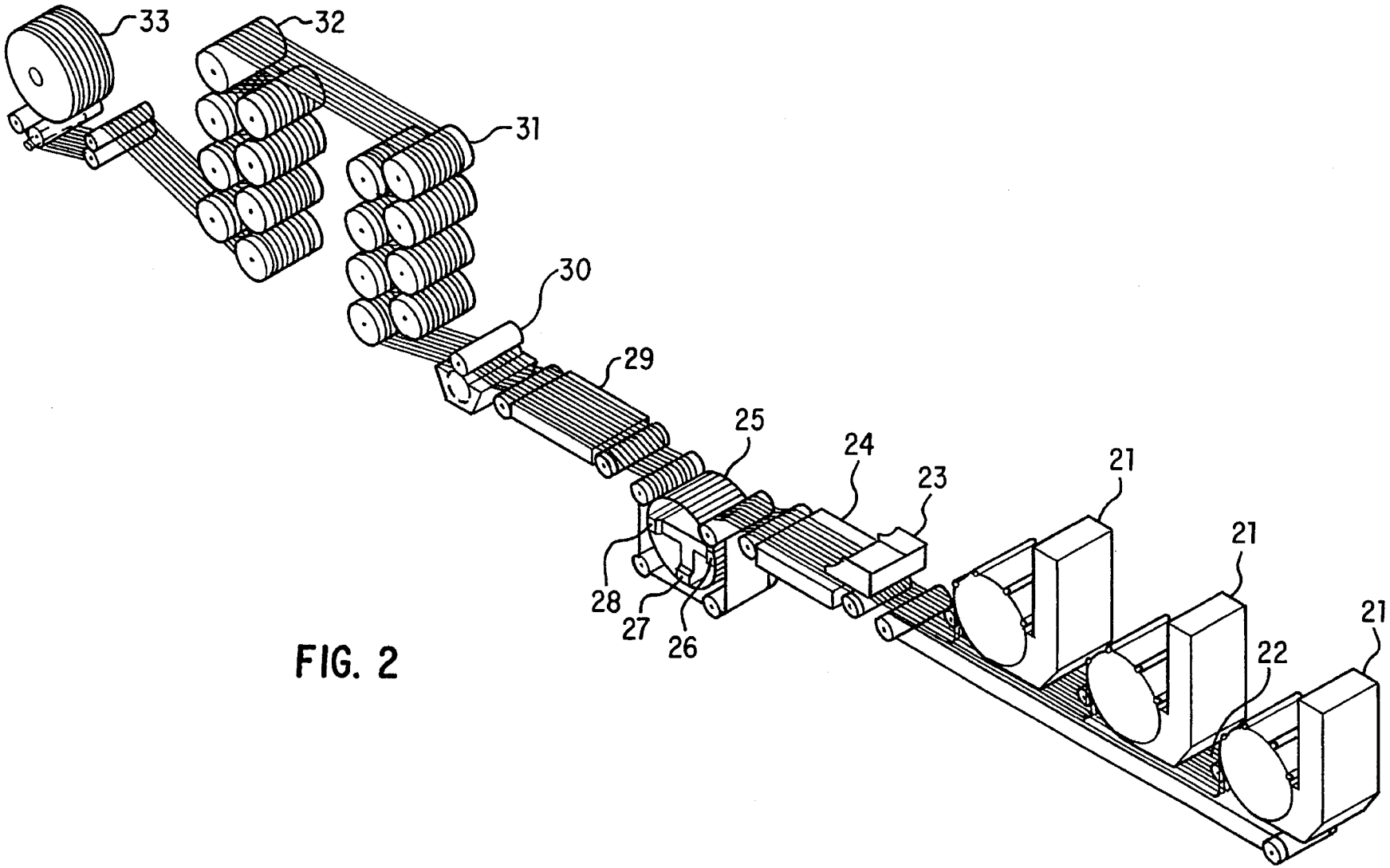
FIG. 2 illustrates another version of a process line for producing a desired nonwoven fabric with PVA binding fibers.
Figure 3:
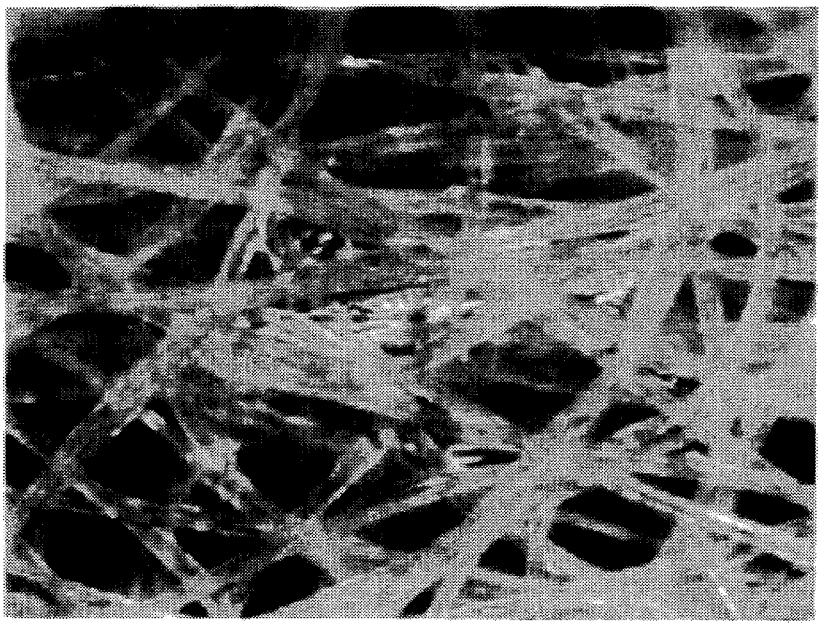
FIG. 3 is a photomicrograph depicting the resulting structure of a nonwoven fabric having PVA binding fibers in accordance with the invention.
Figure 4:
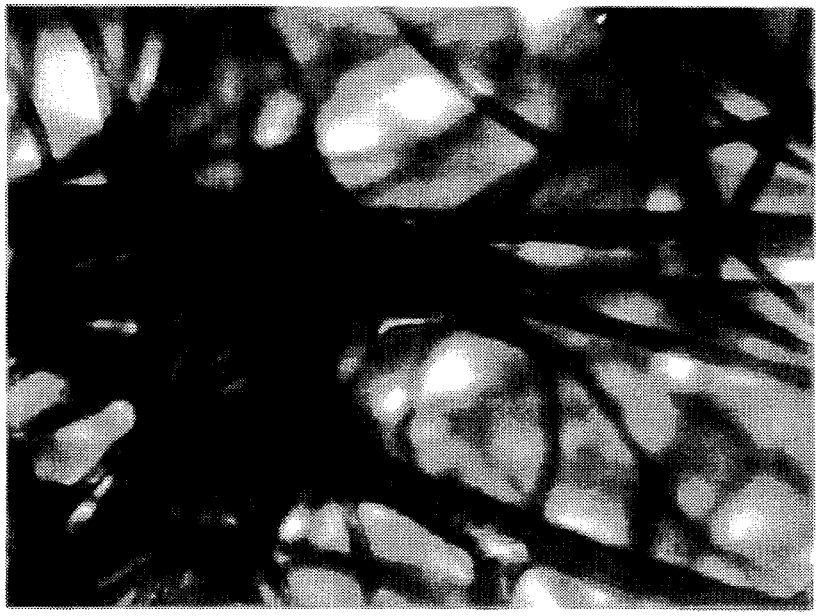
FIG. 4 is a photomicrograph depicting the resulting structure of a nonwoven fabric having PVA binding fibers that is patterned or apertured by hydroentanglement.

Referring to FIG. 2, a variation of the fabrication process line is shown for handling nonwoven fabric of greater weight and absorbent capacity such as used for baby wipes. The PVA and other fibers are blended completely in a homogenized manner and supplied to (three) card units 21 at a carding station 20 with or without the use of scramblers. The carded fibers are transported on a card conveyor 22. The carded web is passed through a pre-wet station 23 which is essentially a flooder wherein hot or cold water from a tank is applied onto the web controlled using a valve.

The web is passed through an aperturing station 25 using a low energy hydroentangling module. This consists of a perforated rotary drum wherein water jets from manifolds 26, 27, 28 impinge the web at pressure ranging from 50–400 psi. The action of the water jets on the web not only imparts strength through fiber entanglement but also a pattern depending on the pattern of perforations in the aperturing surface. This stage enhances the final fabric's strength and feel/textural aesthetics. A post-aperturing vacuum module 29 is used to suck off excess water from the apertured web, which is important to controlling the hand of the final fabric.

TABLE IV

| RUN # | Wt., gsy and Calpr. mils | Prod. Hand | DRY TENS MD GRAB gm/in | DRY TENS CD GRAB gm/in | Drape Stiffness MD STRIP gmf | Drape Stiffness CD STRIP gmf | Fluid cap. gm/gm |
|---|---|---|---|---|---|---|---|
| 1 | 37 gsy 18 mils | Very Stiff | 9080.0 | 3951.0 | 18.5 | 11.4 | 12.6 |
| 2 | 37 gsy 16 mils | Very Stiff | 11123.0 | 2814.8 | 18.4 | 10.6 | 12.6 |
| 3 | 50 gsy 22 mils | Very Stiff | 12848.2 | 4313.0 | 18.5 | 12.5 | 12.3 |
| 4 | 75 gsy 34 mils | Stiff, Bulky & Softer | 12666.6 | 2406.2 | 14.7 | 9.4 | 14.1 |
| 5 | 67 gsy 34 mils | Stiff, Bulky & Softer | 9488.6 | 2678.6 | 17.0 | 8.3 | 14.3 |
| 6 | 78 gsy | Stiff, Bulky | 12258.0 | 2814.8 | 17.1 | 8.3 | 13.0 |

TABLE IV-continued

| RUN # | Wt., gsy and Calpr. mils | Prod. Hand | DRY TENS MD GRAB gm/in | DRY TENS CD GRAB gm/in | Drape Stiffness MD STRIP gmf | Drape Stiffness CD STRIP gmf | Fluid cap. gm/gm |
|---|---|---|---|---|---|---|---|
| | 35 mils | & Softer | | | | | |

With the desired amount of water present in the web and just enough web integrity, the web is passed through a padder station 30 where water is applied to the web in a controlled amount under a nip roll. The web is then passed through two stages of hot cylinders 31 and 32 for bonding of the fibers and drying. The bonded fabric is wound up at a winding station 33. Examples of apertured rayon/PVA fabric produced in this process line are given below.

EXAMPLE 5

Hydroentangled Rayon/PVA Blend

A first test for apertured nonwoven fabric used a fixed fiber blend of 96% rayon (1.5 dpf×40 mm) and 4% PVA fibers (3.0 dpf by 51 mm). A cold water pre-wet flooder was not used. The manifold pressures at the aperturing station were all 150 psi. The post-aperturing vacuum pressure was −70.0 to −80.0 psi. The doctor blade and nip roller of the padder were not used. The line speed was 50 fpm. The steam pressure was 30 psi around the first-stage cylinders and 40 psi around the second-stage cylinders. Five samples were tested, with Runs #4 and #5 having a top layer of 5 dpf rayon. Drape was measured using the INDA Standard Test for Stiffness (IST 90.1–92) in centimeters of bend (the higher the value, the stiffer the fabric). The measured fabric properties are summarized in Table VA.

TABLE VB

PVA IN BLEND (%) VERSUS NONWOVEN PROPERTIES

| RUN # | Wt. gsy | Rayon/ PVA % | Dry tens MD strip g/in/gsy | Wet tens MD strip g/in/gsy | Dry tens CD strip g/in/gsy | Wet tens CD strip g/in/gsy |
|---|---|---|---|---|---|---|
| 1 | 64.5 | 98/2 | 65.2* | 27.3 | 4.3* | N/A |
| 2 | 63.4 | 96/4 | 66.8* | 27.9* | 5.5* | 4.3* |
| 3 | 71.1 | 90/10 | 98.7 | 33.1 | 13.1 | 5.5 |
| 4 | 72.8 | 84/16 | 110.3 | 33.1 | 16.2 | 5.0 |
| 5 | 69.5 | 82/18 | 127.2 | 38.4 | 15.4 | 5.9 |

TABLE VA

| RUN # | WGT/THICK | DRY STRIP TS | WET STRIP TS | DRAPE (cms) | FLUID CAPAC. |
|---|---|---|---|---|---|
| 1. | 51 gsy<br>28 mils | MD 2637 gm<br>CD 250 gm | MD 924 gm<br>CD 166 gm | MD 13.4<br>CD 5.0 | 15.0 g/g |
| 2. | 45 gsy<br>23 mils | MD 3634 gm<br>CD 288 gm | MD 1198 gm<br>CD 134 gm | MD 15.8<br>CD 4.9 | 14.0 g/g |
| 3. | 68 gsy<br>32 mils | MD 6854 gm<br>CD 582 gm | MD 2101 gm<br>CD 244 gm | MD 18.5<br>CD 75.0 | 13.5 g/g |
| 4. | 61 gsy<br>35 mils | MD 4192 gm<br>CD 441 gm | MD 1494 gm<br>CD 167 gm | MD 15.4<br>CD 6.0 | 14.1 g/g |
| 5. | 52 gsy<br>29 mils | MD 4270 gm<br>CD 266 gm | MD 1187 gm<br>CD 141 gm | MD 16.2<br>CD 4.7 | 14.4 g/g |

The test results in Table VA showed wet-to-dry strength ratios ranging between 25% to 40%, relatively soft hand, and good absorptive capacity. Sink times of 2.4 to 3.0 seconds, wicking in the MD of 4.0 to 6.0 cm/sec, and wicking in the CD of 3.7 to 4.9 cm/sec were also measured.

Tests of different rayon/PVA fiber blends were then conducted to determine the optimal fiber compositional ranges, where the product was optimized to be used as a baby wipe. All trials were run at 50 fpm using scrambled web. The same fabrication process for apertured fabric as in the tests for Table VA was used.

Figure 13:
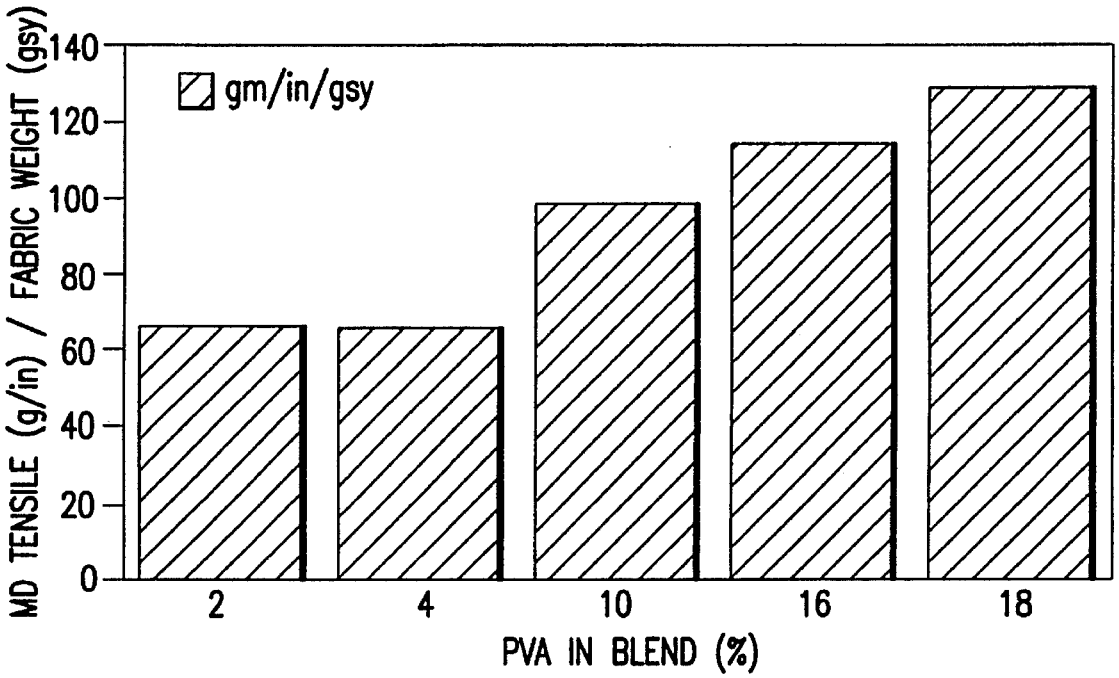
FIG. 13 is a bar chart comparing the PVA fiber percentage in apertured nonwoven fabric to MD dry tensile strength.
Figure 14:
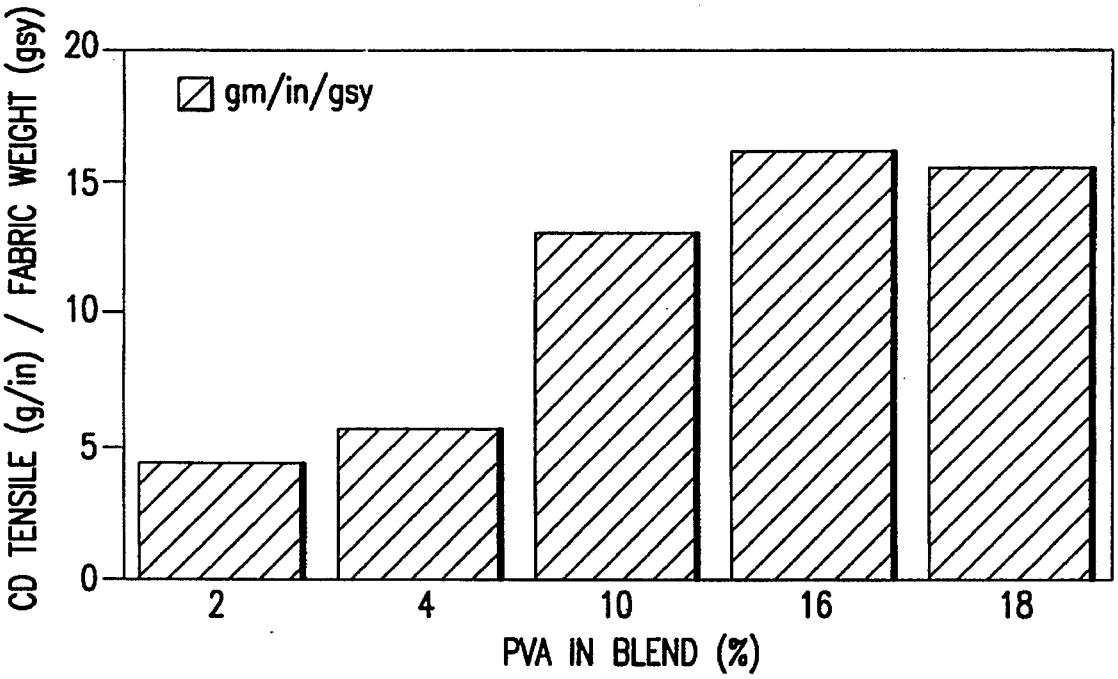
FIG. 14 is a bar chart comparing the PVA fiber percentage in apertured nonwoven fabric to CD dry tensile strength.
Figure 15:
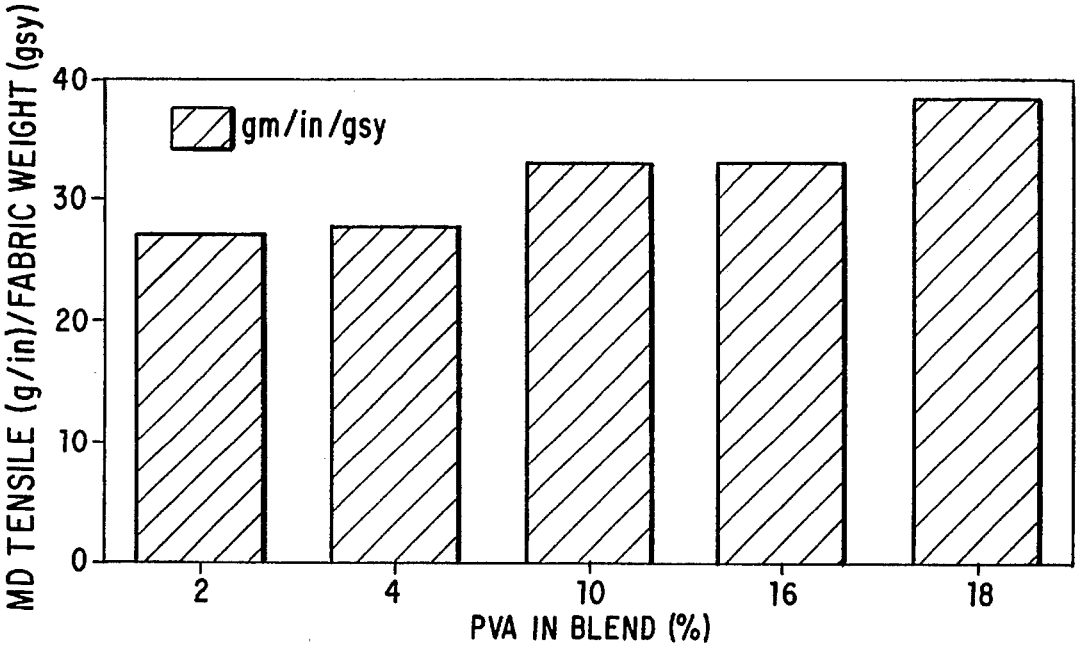
FIG. 15 is a bar chart comparing the PVA fiber percentage in apertured nonwoven fabric to MD wet tensile strength.
Figure 16:
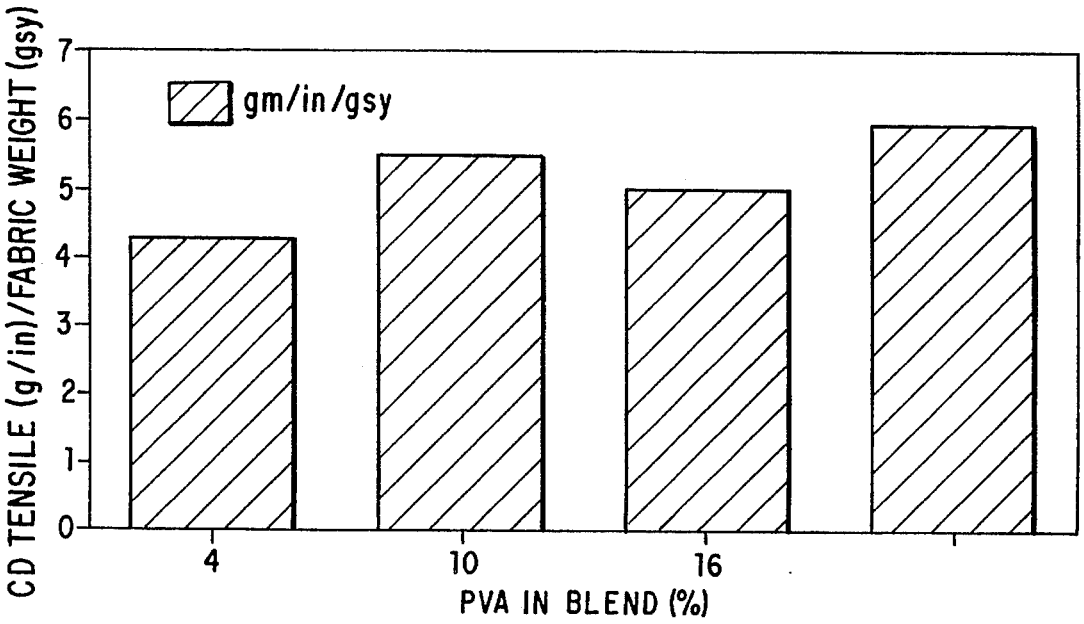
FIG. 16 is a bar chart comparing the PVA fiber percentage in apertured nonwoven fabric to CD wet tensile strength.

Table VB shows a summary of the PVA fiber compositions and their nonwoven properties. FIGS. 13–16 are bar charts depicting the tests results comparatively. FIG. 13 illustrates the PVA fiber percentage amount versus weight-normalized MD dry tensile strength, FIG. 14 the PVA fiber percentage versus CD dry tensile strength, FIG. 15 the PVA fiber percentage versus MD wet tensile strength, and FIG. 16 the PVA fiber percentage versus CD wet tensile strength.

The test results showed that the values for the lower PVA fiber percentages, i.e., 2% and 4%, were statistically better than the values obtained for the 10%, 16%, and 18% rayon/PVA blends. There was little additional value in increasing the PVA fiber composition greater than 10% as the resulting properties showed no significant improvement.

Figure 17:
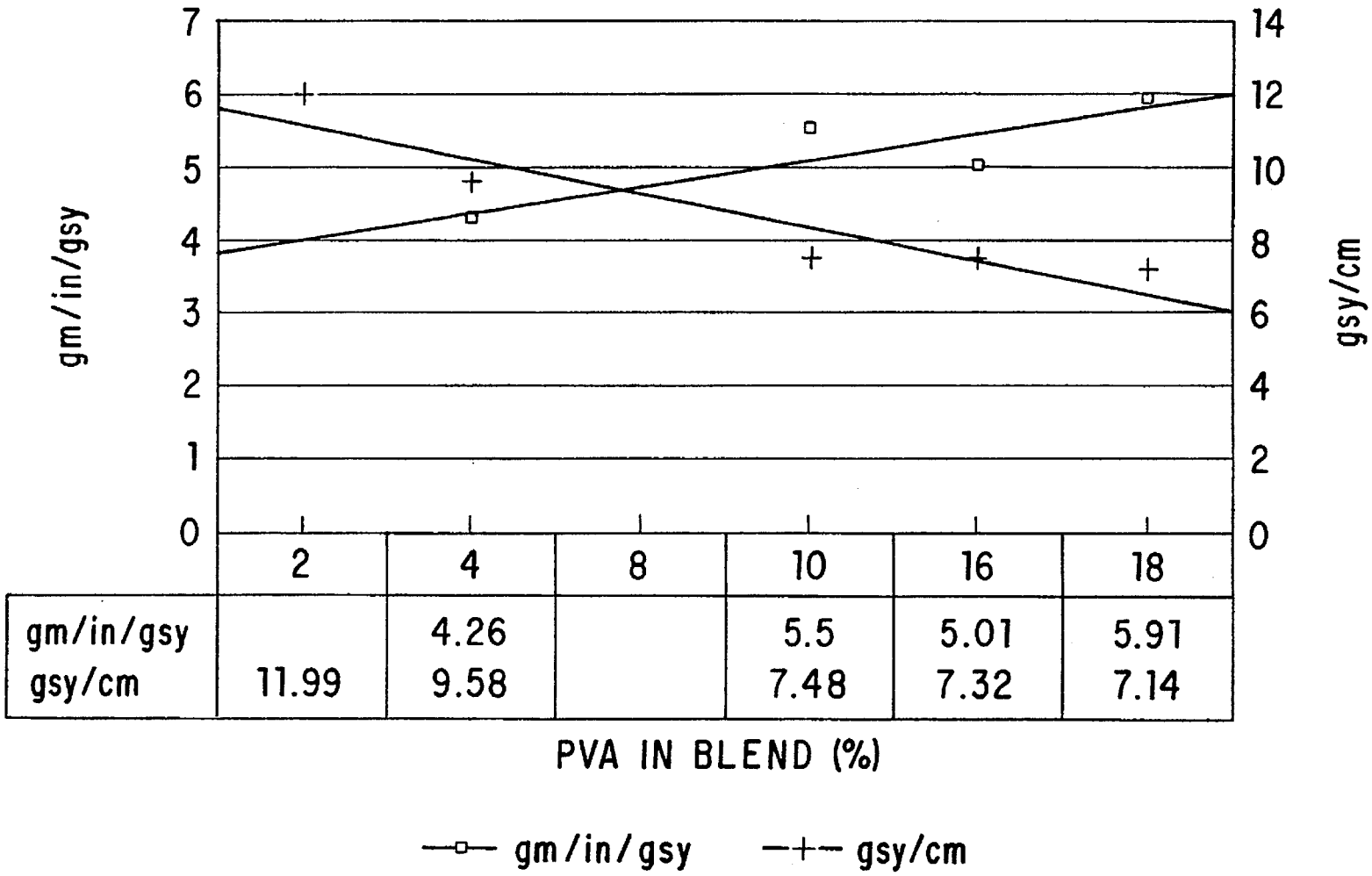
FIG. 17 is a chart illustrating the interaction between wet strength and dry softness for apertured nonwoven fabric.

FIG. 17 illustrates the interaction of the two important variables to be optimized, i.e., cross directional wet strength and cross directional softness (inverse of dry stiffness). Both values were normalized on a fabric weight basis to eliminate the effects of weight variations. The PVA fiber percentages are shown along the X-axis. Weight-normalized wet tensile strength values (gm/in/gsy) are shown along the Y1-axis.

The higher the value, the stronger is the material. The inverse of weight-normalized drape stiffness (gsy/gmf) are shown along the Y2-axis. The higher the value, the softer is the material. The value lines intersect at 8% PVA fiber blend, representing an optimal combination of wet strength and softness.

EXAMPLE 6

Hydroentangled Rayon/PVA Blend

The fiber blend used was 96% rayon (1.5 dpf×40 mm) and 4% PVA fibers (3.0 dpf by 51 mm). A cold water pre-wet flooder was used. The manifold pressures at the aperturing station were 150 and 200 psi. The post-aperturing vacuum pressure was −40.0 psi. The doctor blade and nip roller of the padder were not used. The line speed was 50 fpm. The steam pressure was 20 psi around the first-stage cylinders and 10 psi around the second-stage cylinders.

Different weights and thicknesses of fabric were tested, and the measurements for the resulting properties are summarized in Table VI. The test results showed wet-to-dry strength ratios ranging between 20% to 50%, good softness values, and high fluid absorption capacities.

In summary, nonwoven fabrics having low amounts of PVA fibers bonded to other absorbent fibers such as rayon and cotton are found to have sufficient wet strength and good hand and softness along with excellent fluid handling and absorption properties. These nonwoven fabrics are highly suitable for use in tampons, diapers, sanitary napkins, wipes, and medical products. The fluid holding capacity can be increased when superabsorbent fibers are introduced in the matrix and bonded together with the PVA fibers. Hence, these fabrics also find ideal use as an absorptive core material.

The proportion of PVA fibers in the matrix can be varied depending on the denier and staple length employed. PVA fiber blends of from about 2% up to about 10% are found to provide the required wet strength and softness properties desired for the applications mentioned above. These low amounts provide a wet-to-dry tensile strength ratio of at least 25% in the machine direction (MD) and in the cross direction (CD), drape softness of between 0.5 to 4.0 gmf/gsy in the MD and 0.1 to 0.5 gmf/gsy in the CD. Apertured nonwoven fabric having the PVA binding have high fluid absorptive capacities of between 8 and 20 grams of water per gram of fabric. More than 10% of PVA fibers does not provide an appreciable increase in strength but has increased stiffness, which is a deterrent to use in many of the applications mentioned. Softness and wet strength are the principal combination of properties desired.

TABLE VI

| PROPERTIES | Roll #1 | Roll #2 | Roll #3 | Roll #4 |
|---|---|---|---|---|
| Weight/Thickness | | | | |
| Weight, gsy | 67.7 | 65.3 | 69.6 | 69.0 |
| Thickness, mils | 33.0 | 31.0 | 33.1 | 33.0 |
| DRY-STRIP TENSILE | | | | |
| MD Tensile, gms | 5436.0 | 4617.0 | 6541.0 | 6212.0 |
| CD Tensile, gms | 539.1 | 408.5 | 628.0 | 729.4 |
| MD Elongation, % | 9.8 | 10.5 | 9.3 | 9.7 |
| CD Elongation, % | 41.0 | 38.8 | 30.8 | 38.0 |
| WET-STRIP ($H_2O$) | | | | |
| MD Tensile, gms | 1577.0 | 1588.0 | 2053.0 | 2150.0 |
| CD Tensile, gms | 227.4 | 178.5 | 259.1 | 259.3 |
| MD Elongation, % | 24.4 | 26.7 | 23.2 | 24.1 |
| CD Elongation, % | 115.5 | 89.3 | 103.6 | 95.7 |
| DRY-GRAB TENSILE | | | | |
| MD Tensile, gms | 8762.2 | 7536.4 | 10396.6 | 9761.0 |
| CD Tensile, gms | 2270.0 | 1816.0 | 2996.4 | 2542.4 |
| MD Elongation, % | 12.0 | 12.6 | 10.5 | 10.8 |
| CD Elongation, % | 53.0 | 53.0 | 49.3 | 49.7 |
| WET-GRAB ($H_2O$) | | | | |
| MD Tensile, gms | 3132.6 | 2905.6 | 3541.2 | 3541.2 |
| CD Tensile, gms | 1089.6 | 1225.8 | 1316.6 | 1180.4 |
| MD Elongation, % | 34.9 | 36.1 | 32.4 | 32.8 |
| CD Elongation, % | 170.5 | 182.6 | 162.2 | 154.0 |
| DRY-STRIP TOUGH. | | | | |
| MD Tough., gm/in$^2$ | 451.5 | 395.3 | 488.0 | 473.6 |
| CD Tough., gm/in$^2$ | 190.6 | 144.S | 170.1 | 215.1 |
| WET-STRIP ($H_2O$) | | | | |
| MD Tough., gm/in$^2$ | 337.0 | 377.7 | 397.6 | 425.4 |
| CD Tough., gm/in$^2$ | 163.5 | 116.5 | 178.2 | 166.7 |
| DRY-GRAB TOUGH. | | | | |
| MD Tough., gm/in$^2$ | 280.2 | 311.6 | 368.2 | 311.6 |
| CD Tough., gm/in$^2$ | 312.0 | 235.0 | 373.5 | 331.8 |
| WET-GRAB ($H_2O$) | | | | |
| MD Tough., gm/in$^2$ | 397.0 | 361.0 | 379.6 | 425.4 |
| CD Tough., gm/in$^2$ | 337.0 | 371.3 | 381.2 | 166.7 |
| STIFFNESS | | | | |
| MD Drape, cms | 16.9 | 15.2 | 18.5 | 18.5 |
| CD Drape, cms | 6.8 | 5.1 | 7.6 | 8.9 |
| ABSORPTION | | | | |
| Sink time, secs | 1.44 | 1.43 | 1.78 | 1.7 |
| Capacity, gm/gm | 13.0 | 12.6 | 12.0 | 12.2 |

| PROPERTIES | Roll #5 | Roll #6 | Roll #7 | Roll #8 |
|---|---|---|---|---|
| Weight/Thickness | | | | |
| Weight, gsy | 63.8 | 64.4 | 59.7 | 62.5 |
| Thickness, mils | 32.8 | 31.1 | 29.2 | 30.0 |
| DRY-STRIP TENSILE | | | | |
| MD Tensile, gms | 4173.0 | 4504.4 | 4012.0 | 4327.0 |
| CD Tensile, gms | 452.8 | 125.4 | 396.2 | 382.9 |
| MD Elongation, % | 10.4 | 9.6 | 11.2 | 11.1 |
| CD Elongation, % | 41.5 | 41.6 | 48.7 | 38.4 |
| WET-STRIP ($H_2O$) | | | | |
| MD Tensile, gms | 1452.0 | 1390.0 | 1564.0 | 1409.0 |
| CD Tensile, gms | 254.0 | 81.2 | 203.0 | 238.1 |
| MD Elongation, % | 26.2 | 25.7 | 26.8 | 26.7 |
| CD Elongation, % | 115.3 | 116.7 | 107.4 | 110.5 |
| DRY-GRAB TENSILE | | | | |
| MD Tensile, gms | 7854.2 | 7536.4 | 7491.0 | 7536.4 |
| CD Tensile, gms | 1997.6 | 1634.4 | 1816.0 | 1725.2 |
| MD Elongation, % | 12.6 | 12.5 | 13.0 | 12.6 |
| CD Elongation, % | 63.1 | 78.5 | 77.5 | 63.6 |
| WET-GRAB ($H_2O$) | | | | |
| MD Tensile, gms | 2769.4 | 2724.0 | 2814.8 | 2724.0 |
| CD Tensile, gms | 1316.6 | 1135.0 | 1362.0 | 1271.2 |
| MD Elongation, % | 42.1 | 40.2 | 39.6 | 37.1 |
| CD Elongation, % | 200.0 | 194.2 | 199.3 | 194.6 |
| DRY-STRIP TOUGH. | | | | |
| MD Tough., gm/in$^2$ | 347.6 | 384.5 | 372.0 | 391.2 |
| CD Tough., gm/in$^2$ | 176.4 | 45.8 | 164.4 | 124.1 |
| WET-STRIP ($H_2O$) | | | | |
| MD Tough., gm/in$^2$ | 332.0 | 367.7 | 367.6 | 353.3 |

TABLE VI-continued

| | | | | |
|---|---|---|---|---|
| CD Tough., gm/in$^2$ | 179.7 | 57.8 | 135.1 | 161.2 |
| DRY-GRAB TOUGH. | | | | |
| MD Tough., gm/in$^2$ | 274.0 | 307.5 | 272.4 | 281.1 |
| CD Tough., gm/in$^2$ | 309.0 | 302.0 | 316.8 | 279.3 |
| WET-GRAB ($H_2O$) | | | | |
| MD Tough., gm/in$^2$ | 333.7 | 373.4 | 414.6 | 356.0 |
| CD Tough., gm/in$^2$ | 446.4 | 361.2 | 428.4 | 420.4 |
| STIFFNESS | | | | |
| MD Drape, cms | 13.7 | 15.2 | 15.0 | 15.9 |
| CD Drape, cms | 5.9 | 6.5 | 6.5 | 6.8 |
| ABSORPTION | | | | |
| Sink time, secs | 1.66 | 1.62 | 1.65 | 1.54 |
| Capacity, gm/gm | 12.8 | 12.7 | 12.5 | 12.6 |
| PROPERTIES | Roll #9 | Roll #10 | Roll #11 | Roll #12 |
| Weight/Thickness | | | | |
| Weight, gsy | 64.0 | 68.4 | 64.5 | 70.5 |
| Thickness, mils | 30.5 | 34.2 | 31.7 | 34.8 |
| DRY-STRIP TENSILE | | | | |
| MD Tensile, gms | 4512.0 | 5048.0 | 5193.0 | 6112.0 |
| CD Tensile, gms | 148.1 | 173.4 | 221.8 | 268.1 |
| MD Elongation, % | 9.2 | 9.7 | 8.7 | 9.2 |
| CD Elongation, % | 35.6 | 36.6 | 40.3 | 34.4 |
| WET-STRIP ($H_2O$) | | | | |
| MD Tensile, gms | 1638.0 | 1433.0 | 1746.0 | 2154.0 |
| CD Tensile, gms | 231.6 | 244.7 | 118.5 | 298.7 |
| MD Elongation, % | 24.6 | 26.6 | 24.8 | 23.8 |
| CD Elongation, % | 118.0 | 115.0 | 121.3 | 115.1 |
| DRY-GRAB TENSILE | | | | |
| MD Tensile, gms | 7808.8 | 8081.2 | 9307.0 | 10896. |
| CD Tensile, gms | 1997.6 | 1997.6 | 2542.4 | 2860.2 |
| MD Elongation, % | 12.6 | 12.4 | 12.0 | 12.3 |
| CD Elongation, % | 74.8 | 63.8 | 55.5 | 51.1 |
| WET-GRAB ($H_2O$) | | | | |
| MD Tensile, gms | 2678.6 | 3041.8 | 3087.2 | 3405.0 |
| CD Tensile, gms | 1225.8 | 1089.6 | 1362.0 | 1362.0 |
| MD Elongation, % | 35.6 | 39.9 | 33.3 | 30.0 |
| CD Elongation, % | 184.7 | 166.2 | 185.0 | 169.7 |
| DRY-STRIP TOUGH. | | | | |
| MD Tough., gm/in$^2$ | 340.3 | 377.5 | 384.5 | 442.1 |
| CD Tough., gm/in$^2$ | 45.6 | 56.8 | 72.6 | 79.0 |
| WET-STRIP ($H_2O$) | | | | |
| MD Tough., gm/in$^2$ | 366.3 | 359.6 | 402.0 | 439.6 |
| CD Tough., gm/in$^2$ | 165.0 | 178.0 | 86.2 | 216.4 |
| DRY-GRAB TOUGH. | | | | |
| MD Tough., gm/in$^2$ | 269.5 | 333.9 | 331.3 | 397.7 |
| CD Tough., gm/in$^2$ | 358.2 | 310.7 | 381.5 | 368.4 |
| WET-GRAB ($H_2O$) | | | | |
| MD Tough., gm/in$^2$ | 334.8 | 376.6 | 348.4 | 464.9 |
| CD Tough., gm/in$^2$ | 382.4 | 356.5 | 400.1 | 434.9 |
| STIFFNESS | | | | |
| MD Drape, cms | 16.5 | 18.3 | 18.4 | 18.6 |
| CD Drape, cms | 5.5 | 7.3 | 6.7 | 7.8 |
| ABSORPTION | | | | |
| Sink time, secs | 1.63 | 1.77 | 1.62 | 1.63 |
| Capacity, gm/gm | 12.5 | 12.6 | 12.2 | 12.3 |

Although the above examples use cotton and rayon matrix fibers, the PVA binding fibers can also be used with synthetic fibers such as acetate, polyester, polypropylene, polyethylene, nylon, etc. They may also be used with other types of fibers to form higher strength and/or denser nonwoven fabrics such as spunbond, spunlaced, and thermally bonded nonwovens, in order to obtain superior hydrophilic and oleophilic wipes.

Numerous modifications and variations are of course possible given the above disclosure of the principles and best mode of carrying out the invention. It is intended that all such modifications and variations be included within the spirit and scope of the invention, as defined in the following claims.

We claim:

1. An absorbent, flushable, bio-degradable, and medically-safe nonwoven fabric comprising from about 2% up to about 10% of untreated, water-soluble polyvinyl alcohol (PVA) fibers that are heat-bonded to a matrix of absorbent fibers such that said fabric has a wet-to-dry tensile strength ratio of at least 25% in the machine direction (MD) and cross direction (CD) and a drape softness of from 0.5 to 4.0 gmf/gsy in the MD and 0.1 to 0.5 gmf/gsy in the CD.

2. A nonwoven fabric according to claim 1, wherein the preferred range of PVA fibers is from about 4% to about 8% per dry weight of fabric.

3. A nonwoven fabric according to claim 1, wherein the absorbent fibers are cellulosic fibers.

4. A nonwoven fabric according to claim 1, having a preferred composition of about 8% by weight of PVA fibers and 92% by weight of rayon as the absorbent fibers.

5. A nonwoven fabric according to claim 1, having a preferred composition of about 8% by weight of PVA fibers and 92% by weight of cotton as the absorbent fibers.

6. A nonwoven fabric according to claim 1, wherein the absorbent fibers are synthetic fibers selected from the group comprising acetate, polyester, polypropylene, polyethylene, and nylon.

7. A nonwoven fabric according to claim 1, wherein the fiber blend is formed as an apertured fabric.

8. A nonwoven fabric according to claim 7, having a preferred composition of about 8% by weight of PVA fibers and 92% by weight of rayon as the absorbent fibers.

9. A nonwoven fabric according to claim 8, having a fluid absorptive capacity of between 8 and 20 grams of water per gram of fabric.

10. A nonwoven fabric according to claim 3, wherein a preferred fiber composition has about 4% by weight of PVA fibers and 96% by weight of rayon as the absorbent fibers.

11. A nonwoven fabric produced by the following steps:

blending untreated, water-soluble PVA fibers with a matrix of absorbent fibers;

carding the blended fibers onto a moving web;

adding water to the web in an amount sufficient to soften the PVA fibers for binding to the absorbent fibers while maintaining sufficient web integrity;

heating the wetted web in a first stage of heating cylinders in a temperature range of about 40° C. to 80° C. to bind the PVA fibers to the other absorbent fibers;

then further heating the web in a second stage of heating cylinders in a temperature range of about 60° C. to 100° C. to complete the binding of the fibers and drying of the web, wherein the PVA fibers comprise from about 2% to about 10% per dry weight of the fabric.

12. A nonwoven fabric comprising about 8% by weight of PVA fibers and 92% by weight of rayon fibers, the nonwoven fabric being produced by the following steps:

blending untreated, water-soluble PVA fibers with a matrix of absorbent fibers;

carding the blended fibers onto a moving web;

adding water to the web in an amount sufficient to soften the PVA fibers for binding to the absorbent fibers while maintaining sufficient web integrity;

heating the wetted web in a first stage of heating cylinders in a temperature range of about 40° C. to 80° C. to bind the PVA fibers to the other absorbent fibers;

then further heating the web in a second stage of heating cylinders in a temperature range of about 60° C. to 100° C. to complete the binding of the fibers and drying of the web.

13. A nonwoven fabric according to claim 11, wherein water is added to the web through a water pickup station and excess water is removed from the wetted web through vacuum suctioning.

14. A nonwoven fabric according to claim 11, wherein water is added to the web in controlled amounts through a padder.

15. A nonwoven fabric according to claim 11, wherein said absorbent fibers are cellulosic fibers.

16. A nonwoven fabric according to claim 11, wherein a preferred fiber composition has about 8% by weight of PVA fibers and 92% by weight of rayon as the absorbent fibers.

17. A nonwoven fabric according to claim 11, wherein a preferred fiber composition has about 8% by weight of PVA fibers and 92% by weight of cotton as the absorbent fibers.

18. A nonwoven fabric according to claim 11, wherein the absorbent fibers are synthetic fibers selected from the group comprising acetate, polyester, polypropylene, polyethylene, and nylon.

19. A nonwoven fabric according to claim 11, wherein the preferred range of PVA fibers is from about 4% to about 8% per dry weight of the fabric.

20. A nonwoven fabric according to claim 11, further comprising apertures formed by low-energy hydroentanglement of said PVA fibers and said absorbent fibers prior to adding water to the web and heating.

21. A nonwoven fabric according to claim 15, wherein a preferred fiber composition has about 4% by weight of PVA fibers and 96% by weight of rayon as the absorbent fibers.

22. A nonwoven fabric according to claim 21, having a fluid absorptive capacity of between 8 and 20 grams of water per gram of fabric.

* * * * *